US006092568A

United States Patent [19]

Andersson

[11] Patent Number: 6,092,568

[45] Date of Patent: Jul. 25, 2000

[54] PRODUCT VALVE COMPLEX FOR DUAL STREAM FILLING SYSTEM

[75] Inventor: Sven-Arne Andersson, Veberod, Sweden

[73] Assignee: Tetra Laval Holdings & Finance, SA, Pully, Switzerland

[21] Appl. No.: 09/204,676

[22] Filed: Dec. 3, 1998

Related U.S. Application Data

[60] Continuation-in-part of application No. 09/154,380, Sep. 16, 1998, Pat. No. 5,894,845, which is a division of application No. 08/897,554, Jul. 21, 1997, Pat. No. 5,829,476.

[51] Int. Cl.[7] ..... B67D 5/00

[52] U.S. Cl. ..... 141/105; 141/103; 141/104; 222/144.5; 137/597

[58] Field of Search ..... 141/9, 100, 103, 141/104, 105; 137/597, 606; 222/144.5, 145.1, 145.7

[56] References Cited

U.S. PATENT DOCUMENTS

| | | | |
|---|---|---|---|
| 1,855,603 | 4/1932 | Lewis | 137/597 |
| 2,167,438 | 7/1939 | Kaufman | 222/144.5 |
| 2,684,805 | 7/1954 | McBean | 141/9 |
| 5,427,160 | 6/1995 | Carson et al. | 141/9 |
| 5,829,476 | 11/1998 | Kaneko et al. | 137/606 |

*Primary Examiner*—J. Casimer Jacyna
*Attorney, Agent, or Firm*—Welsh & Katz, Ltd.

[57] ABSTRACT

A product valve complex for a dual stream filling complex in which two different products are contained within two different chambers on a packaging machine and utilized to fill a container with both products simultaneously, or just one product. The product valve complex has a series of valves juxtaposed between two product supplies and the packaging machine. The valves ma be controlled by a PLC for proper filling.

4 Claims, 6 Drawing Sheets

PRODUCT VALVE COMPLEX FOR DUAL STREAM FILLING SYSTEM

CROSS REFERENCES TO RELATED APPLICATIONS

This application is a continuation-in-part application of co-pending U.S. patent application Ser. No., now U.S. Pat. No. 09/154,389, filed on Sep. 16, 1998, now U.S. Pat. No. 5,894,845, which is a divisional application of U.S. Pat. No. 5,829,476, (Ser. No. 08/897,554 filed on Jul. 21, 1997 which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to product valves for filling machines. Specifically, the present invention relates to a product valves for a dual stream filing system for a filling machine.

2. Description of the Related Art

Packages formed from a blank are usually processed on a linear form, fill and seal packaging machine. Each blank is delivered to a mandrel of the packaging machine from a carton blank opener. The blank opener is fed with a series of blanks from a magazine. The magazine holds a stack of flat blanks that are erected on the carton blank opener prior to placement on the mandrel.

Once on the mandrel, each carton has its bottom formed prior to placement on a conveyor. On the conveyor, each carton may be fitted with a fitment and sterilized prior to filling and top sealing. Novel filling techniques as disclosed in U.S. Pat. No. 5,687,779 have emerged to fulfill a need in the packaging industry, that need being the ability of a packaging machine to consecutively fill cartons with different products. This breakthrough in the packaging industry has created additional problems that must be met before the full potential of the novel filling systems is realized by dairies and other producers of flowable food products such as milk, juice, yogurt and the like.

One of the most pressing needs is the ability to fill a single product on a dual stream filling system, especially the secondary product which may be metered at a much slower rate than the primary product. There is also a need to accomplish this single product filling without making major modifications to the dual stream filing system.

BRIEF SUMMARY OF THE INVENTION

One aspect of the present invention is a product filling system for filling a series of containers conveyed along a container path with a product. The product filling system includes product supplies, chambers, and a product valve complex. The first product supply is in flow communication with a first product supply line. The second product supply is in flow communication with a second product supply line. The primary chamber holds a primary product on a packaging machine. The primary chamber is in flow communication with a primary fill pipe. The secondary chamber holds a secondary product on the packaging machine. The secondary chamber is in flow communication with a secondary fill pipe, and the secondary fill pipe disposed within the primary fill pipe. The product valve complex has a first valve and a second valve juxtaposed between the first product supply line and a primary and secondary product outlets. The primary product outlet is in flow communication with the primary chamber and the secondary product outlet is in flow communication with the secondary chamber. The product valve complex also has a third valve and a fourth valve juxtaposed between the second product supply line and the primary and secondary product outlets.

Having briefly described this invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
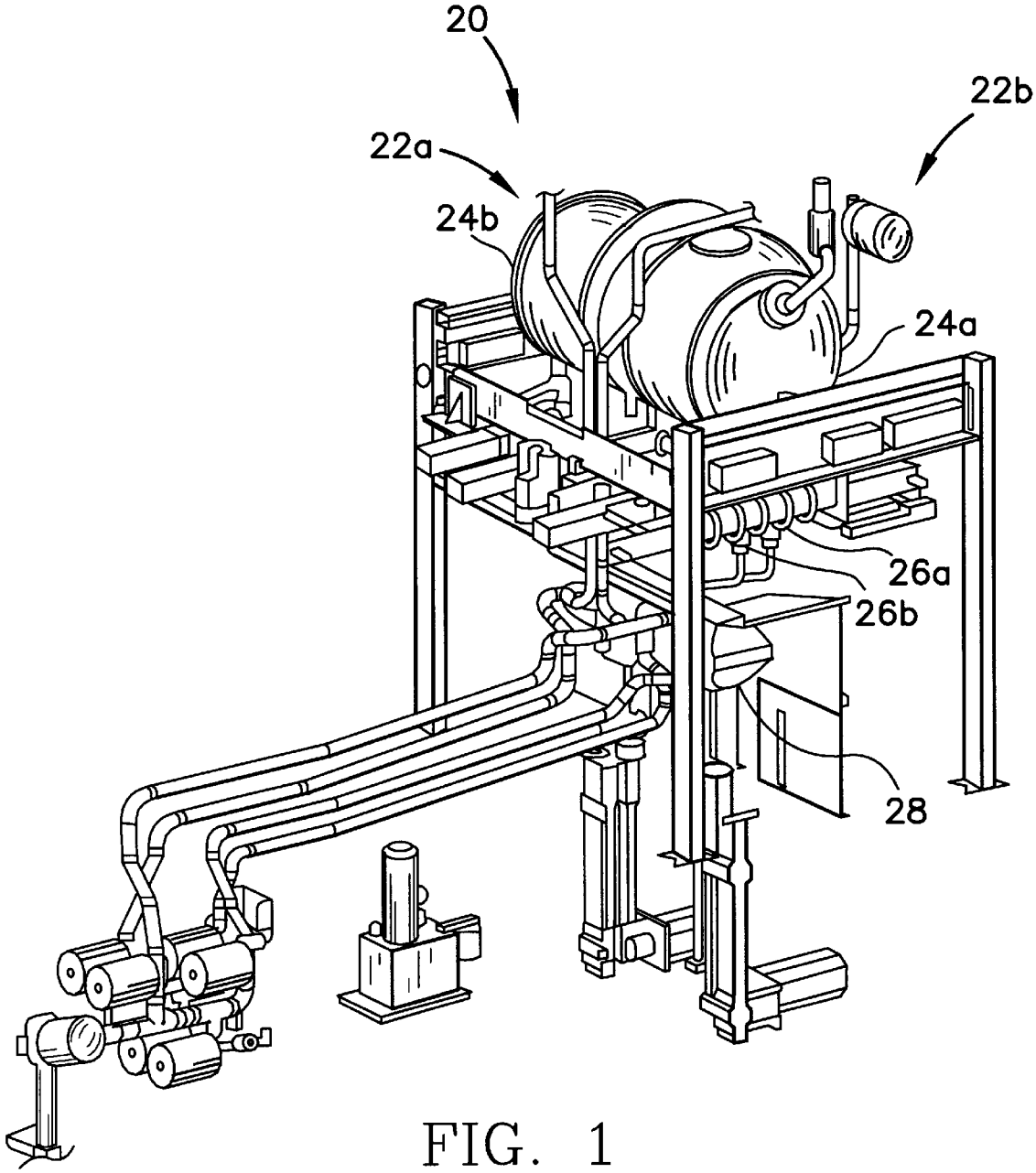
FIG. 1 is a isolated perspective view of a filling system of the present invention for a dual line packaging machine, the filling system having two dual chamber product tanks.

An isolated view of a filling complex 20 is shown in FIG. 1. The filling complex is for a dual line packaging machine wherein two lines of cartons are processed to create formed, filled and sealed cartons with a desired product. The filling complex has two filling systems 22*a–b* positioned adjacent each other on a packaging machine. The most prominent aspect of the two filling systems is the dual chamber product tanks 24*a–b*. The product tanks 24*a–b* are disposed above the conveyor lines and near the top of the packaging machine. A plurality of pumps are disposed beneath the tanks 26*a–b* and further down the flow of product from the tanks 26*a–b* to the cartons are a pair of cleaning boxes 28. The cleaning boxes 28 encompass a plurality of fill pipes, not shown in FIG. 1, that will be described below.

Figure 2:
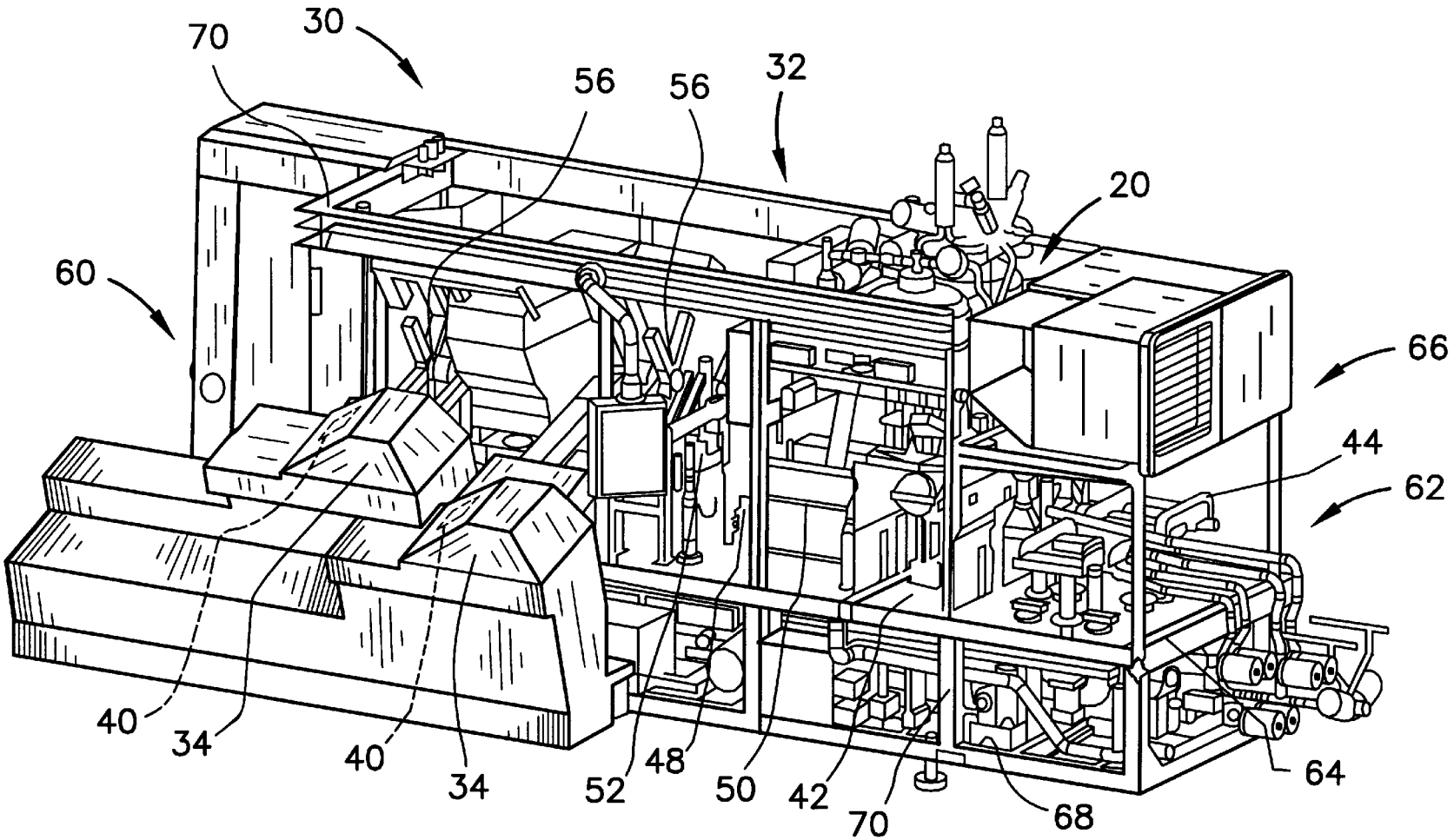
FIG. 2 is a top perspective view of a packaging machine having a filling system of the present invention.

There is illustrated in FIG. 2 a packaging system generally designated 30. The packaging system 30 includes a packaging machine 32, a carton opener 34, a magazine 36. The packaging machine may be a typical linear form, fill and seal packaging machine such as a TETRA REX® packaging machine available from Tetra Pak, Incorporated of Chicago, Ill. The packaging machine 32 may have a programmable logic controller ("PLC")38 to control the various operations of the packaging system 30. Also, disposed within the packaging system 30 there may be a bar code reader 40 which communicates via the PLC 38 the size and filling requirements of each carton to the necessary components of the packaging machine 32, such as the filling complex 20. A bar code reader for a packaging machine is disclosed in co-pending U.S. patent. application Ser. No. 09/063,763 filed on Apr. 21, 1998 and entitled Multi-Product Packaging Machine With Bar Code Reader which is hereby incorporated by reference.

The packaging machine 32 for forming, filling and sealing cartons generally includes a high hygiene zone 42 which is composed of a top sealing station 44 and the filling complex 20, a sterilization station 48 which is composed of an ultraviolet radiation station 50 and a hydrogen peroxide station 52, an optional fitment applicator station, and a bottom forming station 56. From an operational perspective, the front 60 of the packaging machine 32 is where the processing begins, and the rear 62 is where the finished cartons are dispensed for distribution.

The packaging machine 32 may be divided along a horizontal plane defined by a table top 64. The table top 64 divides the packaging machine 32 into an upper half 66 and a lower half 68. A frame 70 defines the general structure of the packaging machine 32 and supports the table top 64 and the various stations. The lower half 68 of the machine 32 includes servomotors, drive cylinders, cam drives and other components. The upper half 66 includes the various stations, the product tanks 24*a–b*, the conveyor system 72, and other components to process cartons.

Figure 3:
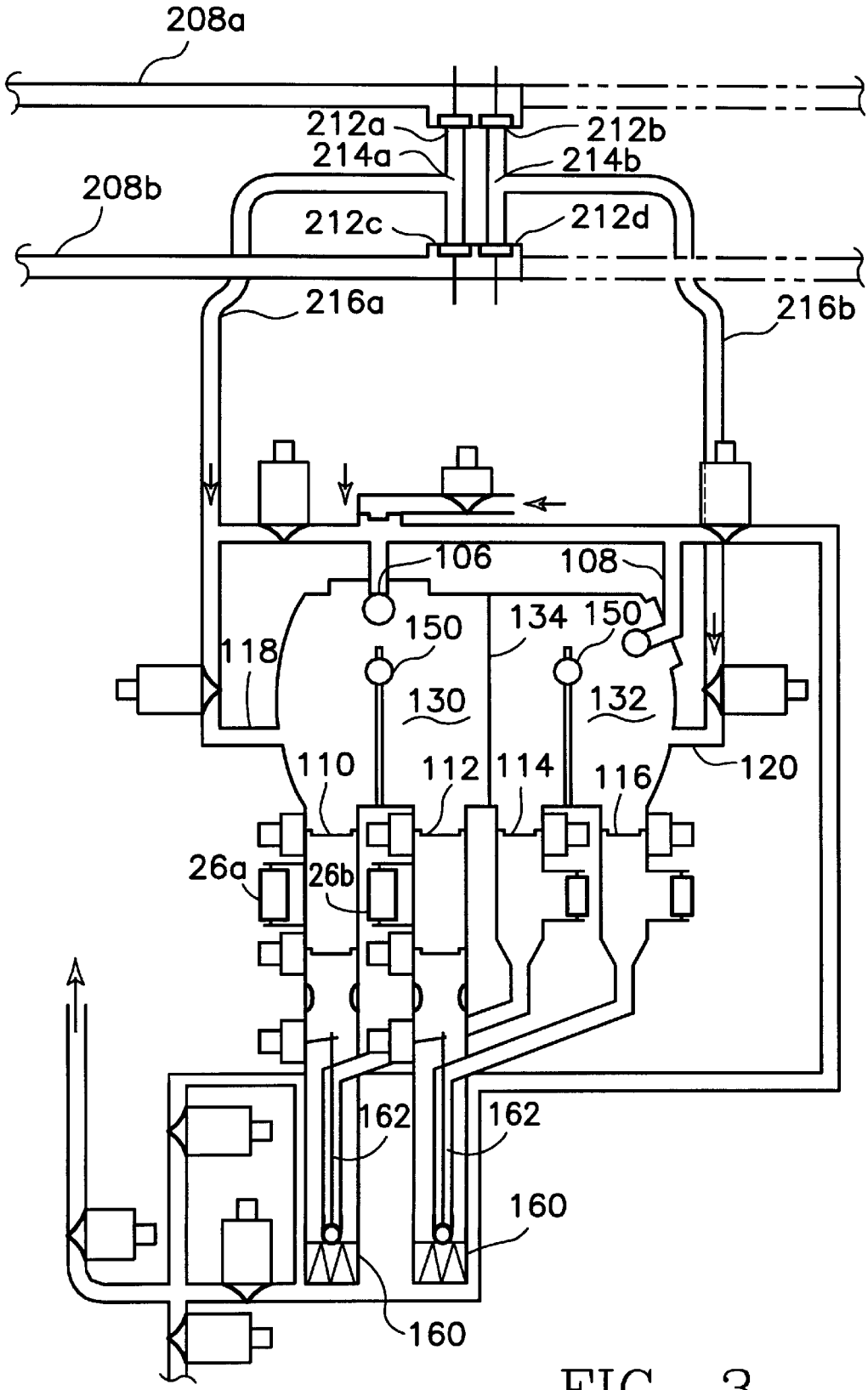
FIG. 3 is a schematic diagram of a filling complex which utilizes the product valve complex of the present invention.

As shown in FIG. 3, each of the chambers 130, 132 have a level probe 150 disposed therein. The level probe measures the level of the product in a chamber and thereby controls the flow of product into the chamber 132. Air in the chambers 130, 132 is ventilated through outlets 106, 108 into through tubing 155 to the area about the plurality primary fill pipes 160 (and the cleaning box 28) in order to maintain like sterile air through the filling complex 20. The sterile air is supplied from a sterile air supply 170, not shown. Cleaning fluid, supplied from a cleaning fluid supply 171, not shown, may also be introduced to the chambers 130 and 132 through outlets 106 and 108.

In this embodiment, each of the plurality of primary fill pipes 160 has a secondary fill pipe 162 concentrically disposed therein. Such as arrangement is described in more detail in U.S. Pat. No. 5,829,476. An alternative arrangement is described in U.S. Pat. No. 5,687,779 which is hereby incorporated by reference. Additionally, those skilled in the art will recognize that the secondary fill pipes 162 may be outside of the primary fill pipes 160 without departing from the scope and spirit of the present invention.

In operation, the primary chamber 130 is partially filled with a primary product such as skim milk. The secondary chamber 132 is partially filled with a secondary product such as cream. Sterile air is introduced through outlets 106 and 108 to fill the chambers 130 and 132. As the product level changes, the sterile air is ventilated through the outlets 106 and 108 through tubing 155 and to the area about the fill pipes 160. The internal wall 134 maintains the separation of products, however, the internal wall 134 does allow for a transfer of heat from one chamber to another chamber. For example, if the secondary product is cream, the secondary chamber 132 is cooled by the primary chamber 130 which may contain skim milk. The flow of the primary product is usually greater than that of the secondary product allowing for cooler product from a main supply tank to cool the primary chamber 130. The lowered flow of the secondary product allows for an accumulation of heat in the secondary chamber 132. The sharing of the internal wall 134 between chambers 130 and 132 allows for the transfer of heat thereby equalizing the temperatures of the chambers 130 and 132.

Figure 3A:
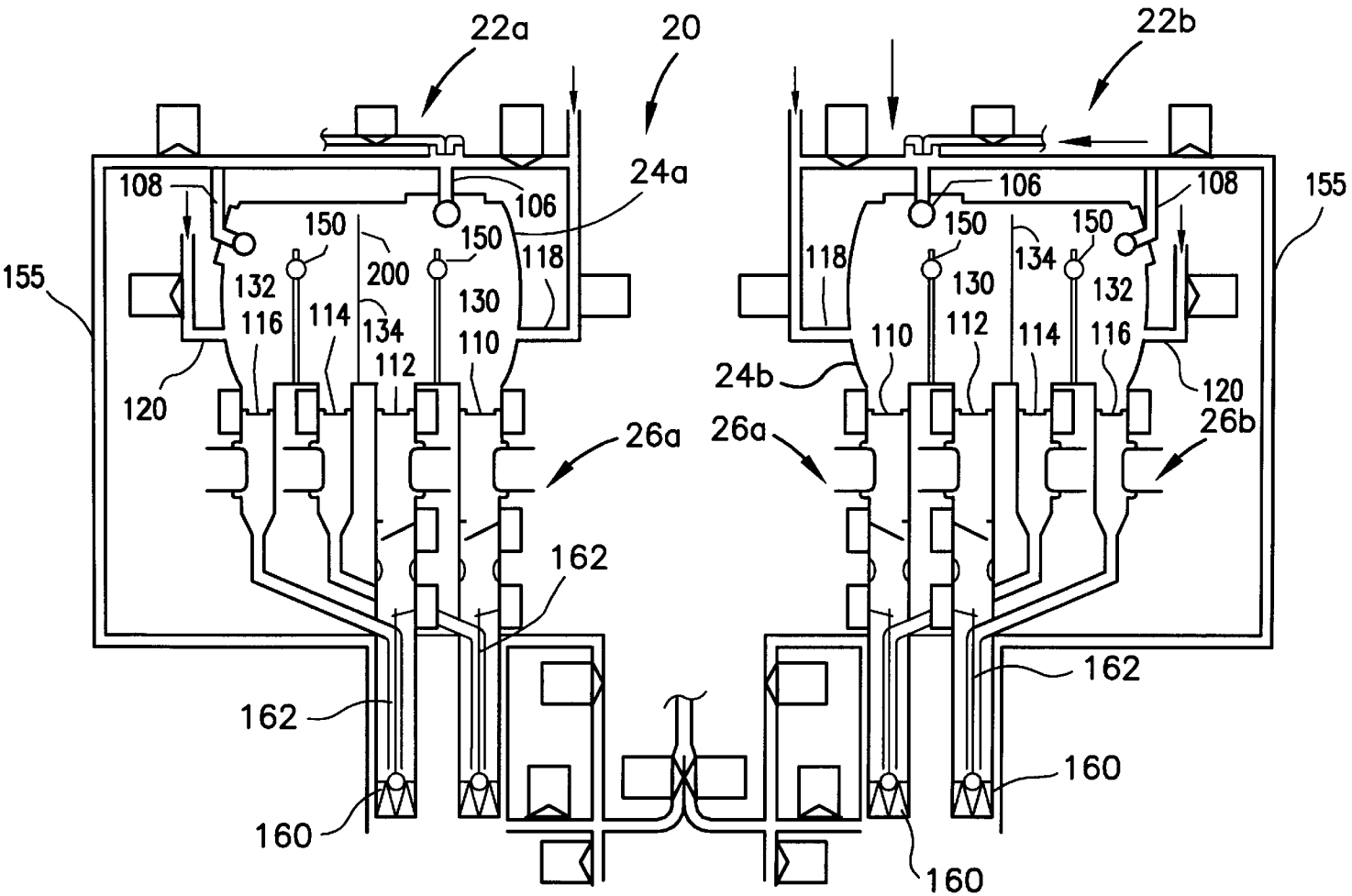
FIG. 3A is a schematic diagram of a filling complex for a double line machine which utilizes the product valve complex of the present invention.

Returning to the filling operation, as cartons are conveyed below each primary fill pipe 160, the PLC will instruct the filling system 22 to fill the carton with a set amount of each of the primary and secondary products to produce a desired product. For example, if two percent milk is desired, a small amount of cream will be dispensed into the carton followed, or concurrently with, a large amount of skim milk to produce the two percent product. FIG. 3A illustrates a dual stream filling complex 20 for a double line machine.

Figure 4:
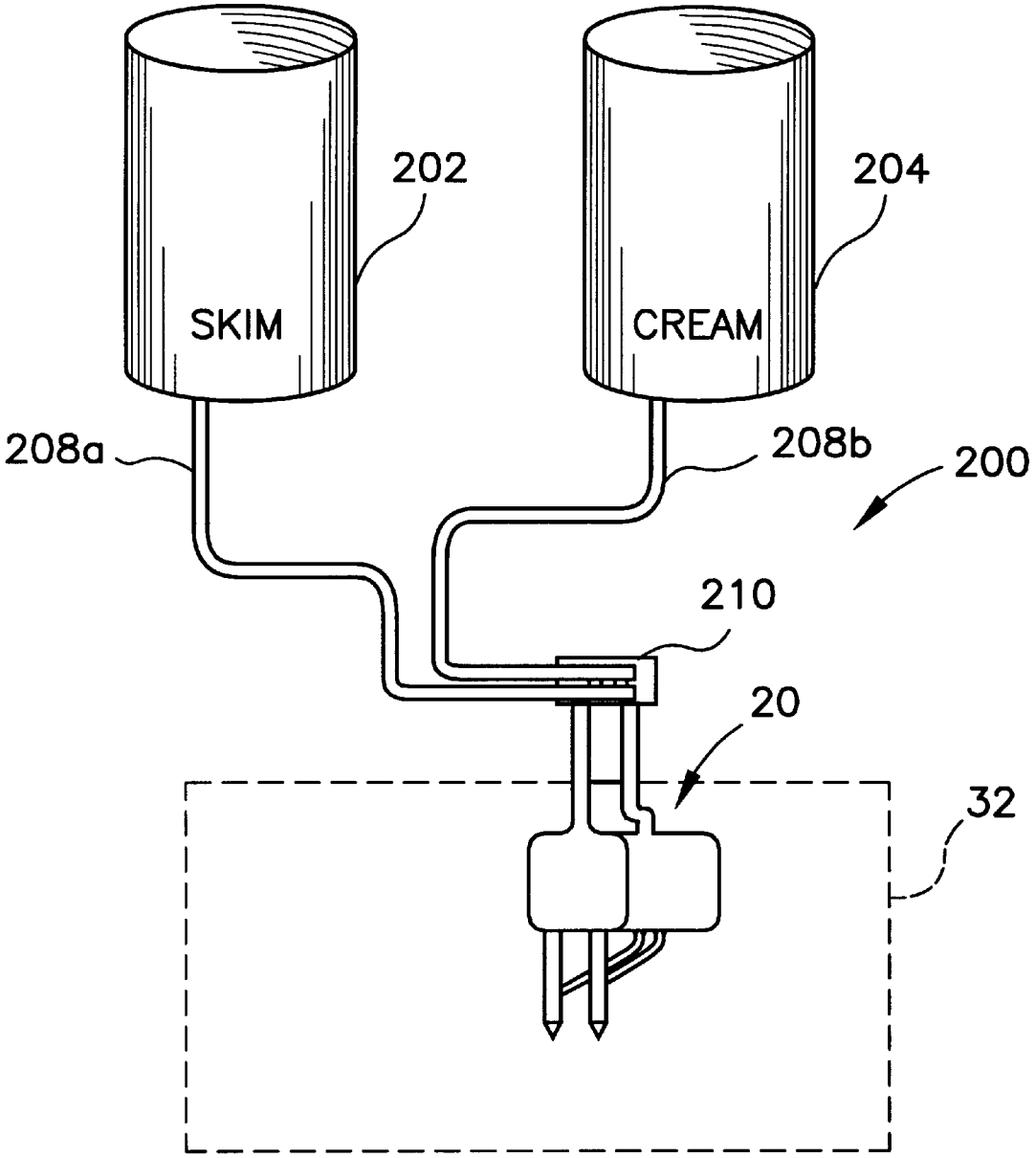
FIG. 4 is a schematic diagram of a product system integrated with the product valve complex of the present invention.

As shown in FIG. 4, the product system 200 includes a supply of a primary product 202 and a supply of a secondary product 204. The product supplies 202 and 204 may be large vats that hold thousands of liters. Alternatively, the product supplies 202 and 204 may be tanker trucks that hold thousands of liters of product and are driven to the filling site for immediate deliver of the product thereby overcoming the need for large storage vats that require substantial space. The product supplies 202 and 204 are in flow communication with the filling complex 20 on the packaging machine 32 through a series of pipes 208*a–b*. A product valve complex 210 is juxtaposed between the pipes 208*a–b* and the filling complex 20. The number of product supplies may be more than two depending on the needs of the facility. A multiple of product supplies will all have piping 208 connected to the product valve mechanism for flow to the filling complex 20 of the packaging machine 32.

Figure 5:
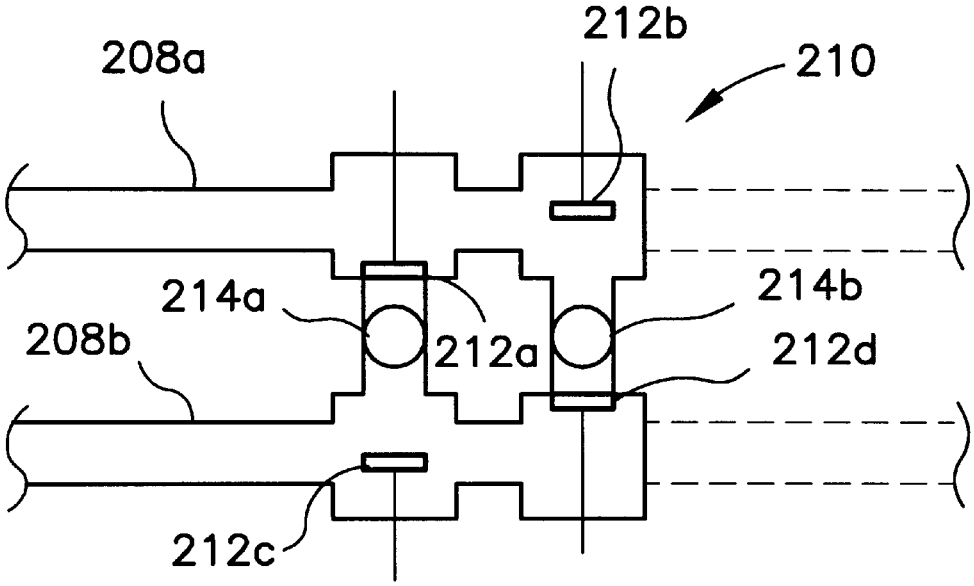
FIG. 5 is a schematic diagram of the product valve complex of the present invention in one operational configuration.
Figure 6:
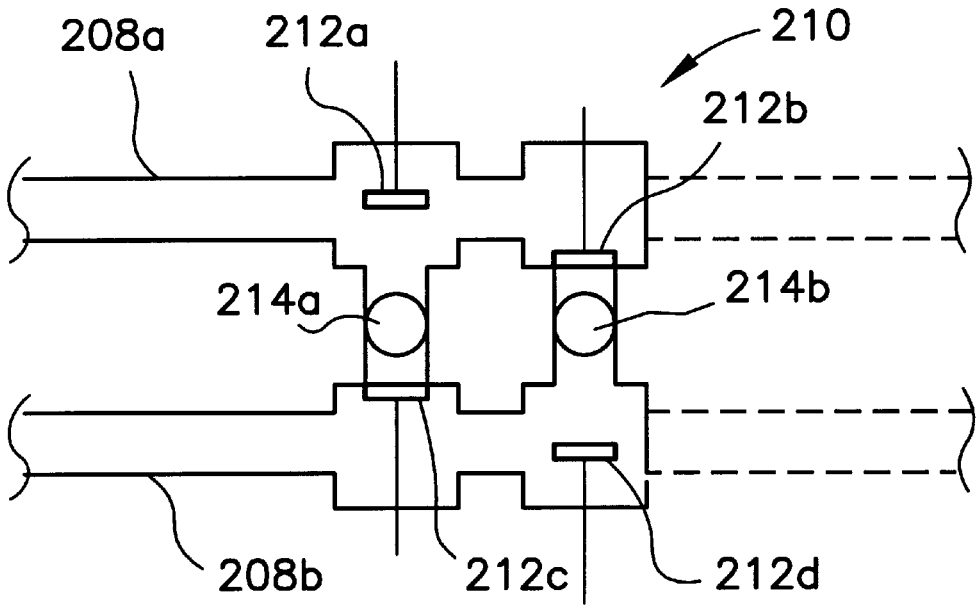
FIG. 6 is a schematic diagram of the product valve complex of the present invention in an alternative operational configuration.

FIGS. 5 and 6 illustrate the product valve complex 210 in operation. The product valve complex 210 includes a plurality of valves 212*a–d* that control the flow of product to a plurality of outlets 214*a–b* which are in flow communication with the filling complex 20. The valves 212*a–d* are opened or closed depending on the flow of the products from the product supplies 202 and 204 to the chambers 130 and 132. The product valve complex 210 allows for the exchange of primary product and secondary product in the chambers. Thus, if the secondary product is the only product to be filled in a "product run", then the secondary product would be transferred to the primary chamber 130 of the product tank 24 since filling a single product on such a dual stream filling complex 20 may only be accomplished through the primary fill pipes 160.

Referring to FIGS. 3, 4 and 5, a primary product such as skim milk is dispensed from the primary product supply 202 through the pipe 208*a* to the product valve complex 210. A secondary product such as cream is dispensed from the secondary product supply 204 through the pipe 208*b* to the product valve complex 210. At the product valve complex 210, the valve 212*a* is closed and the valve 212*b* is open allowing for the flow of the skim milk into the secondary chamber 132 through outlet 214*b* and piping 216*b*. The secondary product, cream in this example, is allowed to flow into the primary chamber 130 since valve 212*c* is open and valve 212*d* is closed. The secondary product flows through outlet 214*a* through piping 216*a* and into the primary chamber 130. This allows for filling of a container through fill pipe 160 with only the secondary product, cream. Also, if the secondary product is the major product, and the primary product for a particular product run is the minor component, then the product valve complex 210 configuration of FIG. 5 may be utilized to obtain the necessary product.

The configuration of the product complex 210 in FIG. 6 is the opposite of FIG.5 such that the primary product, skim milk, is allowed to flow into the primary chamber 130, and the secondary product is allowed to flow into the secondary chamber 132. FIG. 6 is the normal operation for dual stream filling through a dual stream filling complex. Further, in FIG.

5, if the filling is only by a single product, the valves 212*a* and 212*b* may both be closed since the primary product would not be used for such a product run.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A product filling system for filling a series of containers conveyed along a container path with a product, the product filling system comprising:

a first product supply in flow communication with a first product supply line;

a second product supply in flow communication with a second product supply line;

a primary chamber for holding a primary product on a packaging machine, the primary chamber in flow communication with a primary fill pipe;

a secondary chamber for holding a secondary product on the packaging machine, the secondary chamber in flow communication with a secondary fill pipe, the secondary fill pipe disposed within the primary fill pipe; and a product valve complex having a first valve and a second valve juxtaposed between the first product supply line and a primary and secondary product outlets, the primary product outlet in flow communication with the primary chamber and the secondary product outlet in flow communication with the secondary chamber, the product valve complex also having a third valve and a fourth valve juxtaposed between the second product supply line and the primary and secondary product outlets.

2. The product filling system according to claim 1 wherein the container is a gable top carton.

3. The product filling system according to claim 1 wherein the container is a plastic bottle.

4. The product filling system according to claim 1 wherein the first, second, third and fourth valves are operable between a closed and an opened position, and the operability of the valves is controlled by a PLC.

* * * * *